US006234823B1

(12) United States Patent
Fuess

(10) Patent No.: US 6,234,823 B1
(45) Date of Patent: May 22, 2001

(54) PLUG ADAPTER HAVING ECCENTRIC RING DRIVING CORD RETENTION WEDGE

(76) Inventor: Paul Martin Fuess, 1425 Witches Willow La., Colorado Springs, CO (US) 80906

( * ) Notice: Subject to any disclaimer, the term of this patent is extended or adjusted under 35 U.S.C. 154(b) by 0 days.

(21) Appl. No.: 09/277,866

(22) Filed: Mar. 29, 1999

(51) Int. Cl.[7] ..... H01R 13/625
(52) U.S. Cl. ..... 439/346; 439/367; 439/371
(58) Field of Search ..... 439/651, 369, 439/368, 367, 346, 371, 463

(56) References Cited

U.S. PATENT DOCUMENTS 2,461,427 * 2/1949 Kneebone ..... 439/369
3,865,461 * 2/1975 Ludwig ..... 439/463
3,942,856 * 3/1976 Mindheim et al. ..... 200/51 R
4,061,409 * 12/1977 Bealmear ..... 439/372
4,605,273 * 8/1986 Horton ..... 439/369
5,605,466 * 2/1997 Devlin et al. ..... 439/144
5,755,588 * 5/1998 Sweatman et al. ..... 439/369

* cited by examiner

*Primary Examiner*—Brian Sircus
*Assistant Examiner*—Son V. Nguyen
(74) *Attorney, Agent, or Firm*—G. F. Gallinger

(57) ABSTRACT

An adaptor which allows a tool having a standard 120 volt plug to be connected to the type of retaining plug outlet preferred by tradesmen, as well as being intermittently connected to a standard 120 volt outlet. The plug adapter comprises: three metal contactors each having a female end portion adapted to receive a prong on the standard plug and an opposite male end portion adapted to engage the retaining outlet; a contactor body surrounding a central portion of the connectors and holds them in spaced alignment; and, a slide which slides a pin through a hole in the end portion of a flat prong of the plug, thereby holding the plug in the body. In another aspect of the invention an elongate central frame has one end portion connected to the body and, has a cord retaining wheel portion having an eccentric inner side portion on the other opposite end portion. After the plug is inserted into the body, and the wheel having an eccentric inner side portion is turned thereby clamping the cord, the plug will not loosen when the plug cord is pulled.

10 Claims, 1 Drawing Sheet

PLUG ADAPTER HAVING ECCENTRIC RING DRIVING CORD RETENTION WEDGE

FIELD OF INVENTION

This invention relates to adapters used to facilitate the electrical connection between electrical tools or appliances having one style of plug and an electrical outlet designed to receive another style of plug. More particularly, this invention relates to a plug adapter used to facilitate connecting a standard 120 volt grounded plug to an electrical outlet adapted to mechanically retain a plug which is rotated therein.

BACKGROUND OF THE INVENTION

The inventor is a carpentry contractor. Tradesmen prefer to use the type of electrical plugs and outlets which retain the plug when the plug is rotated within the outlet. This type of plug and outlet prevents disconnection many times during the day when the plug cord is pulled during use. One problem is that tools are mostly sold with standard electrical plugs. Cutting off the plug and installing the type of plug which is retained when it is rotated is not a good solution to this problem. After the standard plug is cut off the tool cannot be intermittently used in a standard outlet. The process of cutting off the plug and installing another is time consuming. The second plug may not be as durable as the first. Additionally, this procedure may void the warranty on the tool. What is needed is a rugged adapter. An adapter which can be readily installed and removed, so that the tool may be intermittently used with a standard outlet. An adapter which securely locks on the standard plug and which will not pull off of it.

OBJECTS AND STATEMENT OF INVENTION

It is an object of this invention to disclose an adapter which facilitates connecting a tool or appliance having a standard electrical plug to an outlet which mechanically retains the plug when the plug is rotated therein. It is an object of this designed to disclose an adapter which positively locks the prongs of a standard plug within the adapter through the use of a pin. It is yet a further object of this invention to disclose an adapter which conveniently locks on to the cord. It is yet a further object of this invention to disclose an adapter which employs efficient one piece contactors which have both a female end portion adapted to receive a standard plug prong and a male end portion adapted to mate with a retaining plug outlet. It is a final object of this invention to disclose a design for an adapter which has a hinged split shroud which neatly and tightly encloses the plug thereby minimizing the possibility of disconnection when the cord is pulled.

One aspect of this invention provides for a plug adapter for adapting a standard 120 volt electrical plug which has two flat prongs each having holes through their end portions, and a third grounding prong, to a retaining outlet designed to mechanically retain the plug when it is rotated therein comprising: three metal contactors each having a female end portion adapted to receive a prong on the standard plug and an opposite male end portion adapted to engage the retaining outlet; a contactor body 15 surrounding a central portion of the connectors holding them in spaced alignment; and, a retention means adapted to retain the plug prongs in the connectors.

Another aspect of this invention provides for a plug adapter as above wherein the retention means comprises a slide which slides a pin through a hole in the end portion of the flat prong of the plug.

Yet another aspect of the invention comprises a plug adapter as above wherein an elongate central frame having one end portion connected to the body and an opposite end portion extending from the body, and wherein the retention means is a cord retention means positioned on the other opposite end portion so that when the plug prongs are inserted into the body a cord connected to the plug will not loosen when the cord is pulled.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
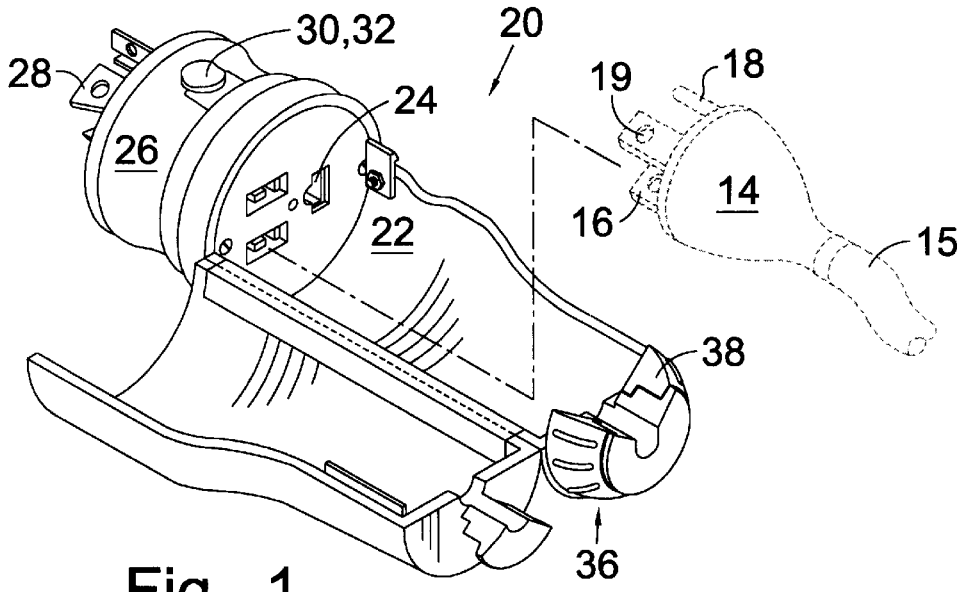
FIG. 1 is a perspective view of a plug adapter having its split shroud in an open position.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a plug adapter 20 having its split shroud 22 in an open position. The plug adapter 20 is used for adapting a standard 120 or 240 volt electrical plug 14 which has two flat prongs 16 each having a hole 19 through its end portion, and a third grounding prong 18, to a retaining outlet (not shown) designed to mechanically retain the plug 14 when it is rotated therein. In its simplest form the plug adapter 20 comprises three metal contactors 24 each having a female end portion adapted to receive a prong 16 or 18 on the standard plug 14 and an opposite male end portion adapted to engage the retaining outlet (not shown); a contactor body 26 surrounding a central portion of the contactors 24 holding them in spaced alignment; and, a retention means 30 adapted to retain the plug prongs 16,18 in the connectors. The retention means 30 is designed so that the plug 14 may be adequately attached in the adapter 20 in the adapter only with one's hands without the need for any hand tools. In the most preferred embodiment of the invention the retaining means 30 comprises a wedge 37 which may be squeezed inwardly into partial collar 39. Wedge 37 and partial collar 39 are respectively carried by opposite sides of split shroud 22.

Figure 2:
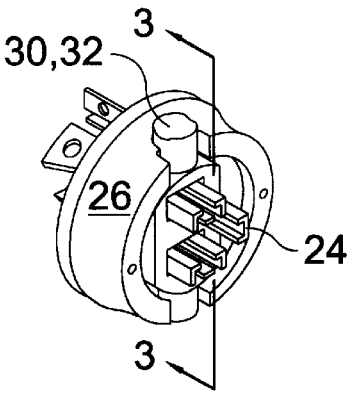
FIG. 2 is a disassembled partial perspective view of a contactor body showing contactors spaced therethrough.
Figure 3:
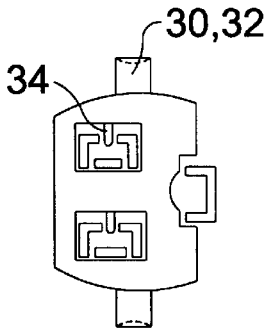
FIG. 3 is an end view of an interior portion of the contactor body as viewed along line 3—3 in FIG. 2. This view shows the slide which moves pins downwardly into the plug prongs when the slide is pushed downwardly.

FIG. 2 is a disassembled partial perspective view of the contactor body 26 showing the contactors 24 which are held in a spaced arrangement and extend through the contactor body 26. FIG. 3 is an end view of an interior portion of the contactor body 26 as viewed along line 3—3 in FIG. 2. In one aspect of the invention the retention means 30 comprises a slide 32 which move two pins 34 through the holes 19 in end portions of the flat prongs 16. In the most preferred aspect of the invention opposite ends of the slide 32 extend beyond the body 26 so that by s electively pressing one of the alternate ends, the pins 34 may engage or disengage the flat prongs 16.

Referring back to FIG. 1 a central frame, which preferably is a split shroud 22 is connected to the body 26 on one end and has a cord retention means 36 on the other opposite end so that when the plug prongs 16,19 are inserted into the body 26 a cord 15 connected to the plug 14 will not loosen when the cord 15 when is pulled. A split shroud 22 is employed to encase the plug 14 so that when the cord 15 is pulled the adaptor 20 will not likely become entangled. Most preferably the body 26 and shroud 22 are made of molded plastic and hinged together by a thin portion of plastic. In the most preferred embodiment the shroud 22 has a generally circular cross section and is split into two halves of generally equal size.

Figure 4:
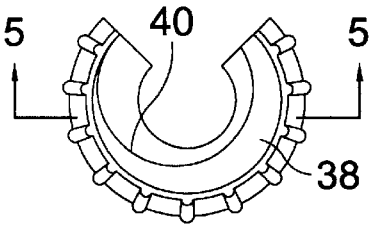
FIG. 4 is an end view of the partial wheel showing its interior eccentric face.
Figure 5:
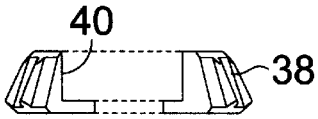
FIG. 5 is a plan view of the partial wheel taken along line 5—5 in FIG. 4.

In the most preferred aspect of the invention the cord retention means 36 comprises a wheel portion 38 having an eccentric inner side portion 40 so that the cord 15 may be engaged when the wheel portion 38 is turned. The shroud 22 is held in a closed position by turning the wheel 38 to engage the cord 15. FIG. 4 is an end view of the partial wheel showing its interior eccentric face 40. FIG. 5 is a plan view of the partial wheel taken along line 5—5 in FIG. 4.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A plug adapter for adapting two flat plug prongs, and a third grounding plug prong of a standard electrical plug having a cord, to a type of prongs designed to mechanically retain the plug when the plug is rotated comprising:

three metal contactors each having a female end portion receiving a prong on the standard plug and having an opposite male end portion;

a contactor body surrounding central portions of the contactors holding the central portions in spaced alignment;

an elongate central frame having one end portion connected to the contactor body and an opposite end portion extending from the contactor body; and a cord retention means carried on the opposite end portion of the elongate central frame, said cord retention means having a wheel portion which has an eccentric inner side portion, and a wedge having an outer edge portion slidably contacting the eccentric inner side portion of the wheel portion and an inner edge portion contacting the cord, so that the wedge is driven inwardly squeezing the cord when the wheel portion having the eccentric inner side portion is turned;

so that when the plug is inserted into the body, and when the wheel is turned squeezing the wedge into the cord, then the cord connected to the plug will not loosen when the cord is pulled.

2. The plug adapter as in claim 1 wherein the frame comprises a split shroud so that the plug is encased to prevent entanglement when the shroud is closed.

3. The plug adapter as in claim 2 wherein the shroud is held in a closed position by turning the wheel to engage the cord.

4. The plug adapter as in claim 3 wherein the body and shroud are molded plastic.

5. The plug adapter as in claim 4 wherein the shroud has a generally circular cross section and is split into two halves of generally equal size.

6. The plug adapter as in claim 2 wherein the split shroud is hinged together by a thin portion of plastic.

7. The plug adapter as in claim 1 wherein the plug adapter comprises a singular integrated structure which can retain the plug without any assembly of unconnected parts.

8. The plug adapter as in claim 1 wherein the two flat plug prongs of the standard electrical plug each have an end portion having a hole therethrough and wherein the contactor body further comprises a slide which slides a pin through the hole in the end portion of one of the flat prongs of the plug.

9. The plug adapter as in claim 8 wherein there are two pins which slide and move through the holes in the flat prongs when the slide is moved.

10. The plug adapter as in claim 9 wherein the slide has opposite end portions, and one of the opposite end portions of the slide extends beyond the contactor body so that by pressing the end of the pin extending beyond the contactor body, the pin alternatively engages and disengages the prongs.

* * * * *